United States Patent [19]

Graham et al.

[11] Patent Number: 4,543,872

[45] Date of Patent: Oct. 1, 1985

[54] BLAST ATTENUATOR

[76] Inventors: Kenneth J. Graham, 2012 Coral Sea Cr.; Robert G. S. Sewell, 313 E. Far Vista, both of Ridgecrest, Calif. 93555

[21] Appl. No.: 520,926

[22] Filed: Aug. 8, 1983

[51] Int. Cl.[4] ..... C06B 21/00; E06B 9/00

[52] U.S. Cl. ..... 86/1 B; 109/1 R; 109/49.5

[58] Field of Search ..... 109/1 R, 26, 49.5; 89/36 R; 86/1 B, 1 R; 252/602, 3; 220/88 R, 88 B

[56] References Cited

U.S. PATENT DOCUMENTS

| | | | |
|---|---|---|---|
| 3,356,120 | 12/1967 | Nohmura | 86/1 B |
| 3,570,749 | 3/1971 | Sato et al. | 86/1 B |
| 3,721,201 | 3/1973 | Boller | 109/49.5 |
| 3,739,731 | 6/1973 | Tabor | 109/49.5 |
| 3,786,956 | 1/1974 | Tabor | 86/1 B |
| 3,820,435 | 6/1974 | Rogers et al. | 89/1 R |
| 3,874,457 | 4/1975 | Thrash | 169/47 |
| 4,013,190 | 3/1977 | Wiggins et al. | 220/22 |
| 4,027,601 | 6/1977 | Hickerson | 109/1 R |
| 4,169,403 | 10/1979 | Hanson | 86/1 B |
| 4,432,285 | 2/1984 | Boyars et al. | 86/1 B |
| 4,454,798 | 6/1984 | Shea et al. | 89/14 B |

FOREIGN PATENT DOCUMENTS

| | | | |
|---|---|---|---|
| 2100845 | 1/1983 | United Kingdom | 86/1 B |

*Primary Examiner*—Stephen J. Lechert, Jr.
*Assistant Examiner*—Howard J. Locker

[57] ABSTRACT

A blast attenuator device is disclosed comprising a collapsible/inflatable cylinder for containment of a body of foam therein. The cylinder is provided with a slitted floor such that the explosive device to be contained can be inserted therethrough. The blast attenuator is self contained and is provided with a compressed gas cannister for inflating the cylinder and foam generating cannister for automatically dispensing foam into the cylinder. The blast attenuator device can be deflated and compactly rolled up from a cylinder eight feet in height and eight feet in diameter to a bundle approximately four feet long for convenient storage and transport. Once the blast attenuator has been unpacked and placed over the explosive device, the inflating device can be turned on, the cylinder automatically inflates, and the foam cannister automatically dispenses foam after cylinder inflation to a specified height.

1 Claim, 4 Drawing Figures

BLAST ATTENUATOR

BACKGROUND OF THE INVENTION

1. Field of the Invention

The invention relates to the areas of ballistics and mechanics. More specifically, the invention relates to a device that contains or attenuates an explosive charge. In particular, the invention is a collapsible, inflatable enclosure for containment of a water-based foam, said enclosure to be placed over and around an explosive charge to be contained.

2. Description of the Prior Art

Several devices have been designed for the purpose of attenuating the destructive blast or concussion effects of an explosive charge positioned in a building or a densely populated area by, for example, terrorist activities.

One such blast inhibiting device provided for two telescoping metallic cylinders for containment of a blast by placing the bomb to be contained in a first cylinder, and then sliding a second cylinder over said first cylinder. Another blast inhibitor provided a thick walled sphere with a plurality of concentric spheres internal thereto for placement and confinement therein of a bomb. Yet another device involved placing an explosive charge in a laminated bucket with a removable bottom for picking up a bomb and transporting it to a position of safety. Should the bomb prematurely explode, the explosive force is absorbed in part by lamination break up. Another device provided for placing an explosive charge in a metallic cylinder having hollow walls. The cylinder walls were filled with water and the cylinder interior itself containing the bomb was filled with liquid nitrogen.

Though these devices did confine to some extent various small explosive charges, their overall efficiency and safety was limited; the heavy, bulky, expensive, metallic structures involved lack the light weight portability desirable for antiterrorist activities. In addition, surrounding an explosive charge with a liquid such as water was found to increase the damaging blast effect rather than to attenuate the blast as was believed.

In short, there exists a long standing need for a blast attenuating device having a greater efficiency for absorbing blast effects than presently exist in the art, yet that is more flexible in use, less expensive to fabricate, and that is more compact and portable.

SUMMARY OF THE INVENTION

A blast attenuating device is disclosed comprising a collapsible, inflatable cylindrical structure consisting of a plurality of stacked, inter-connected, toroidal shaped, gas filled tubes for containment of a water-based foam. A flexible sheath stretches across a base of said cylindrical structure and is provided with an opening therein to allow insertion therethrough of an explosive device. A compressed gas cannister and a foam solution cannister are affixed exterior to the cylinder to provide for inflation of the cylinder and to provide for foam filling the cylinder when the cylinder is at a sufficient height to contain the injected foam.

OBJECTS OF THE INVENTION

An object of the invention is to provide a blast attenuating device.

A further object of the invention is to provide a blast attenuating device that is compact, portable, light weight, collapsible, and that can be operated by one person.

Yet another object is to provide a blast attenuating device that is inexpensive in design and has substantially greater efficiency in curtailing explosive damage than presently exists in the art.

Another object of the present invention is to provide a blast attenuating device that can be remotely operated, automatically operated, and that is simple in design and operation.

Still another object is to provide a blast attenuating device that can be conveniently and efficiently folded and stored when not being used, that comprises readily available component parts, and that can be conveniently manufactured in large numbers at minimal cost.

The specific nature of the invention, as well as other, objects, uses, and advantages thereof, will clearly appear from the following description and from the accompanying drawing, wherein:

DESCRIPTION OF THE PREFERRED EMBODIMENT

Figure 1:
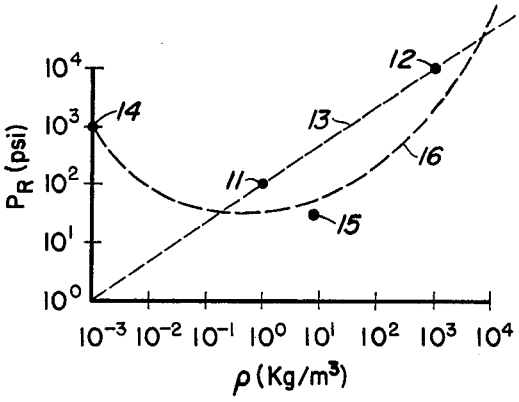
FIG. 1 is a log-log plot of the reflected pressure of an explosive charge versus the medium density within which the explosive charge is situated.

Referring to FIG. 1, the purpose and application of the present invention will become more readily apparent. Characteristic data for reflected pressure as shown in FIG. 1 of an explosive charge in the mediums of air, Point 11, and water, Point 12, have been observed and known for some time. It has been long believed that a straight line relationship 13 linking air 11 and water 12 existed for mediums more dense or less dense than air and water. In fact it has been recently observed that a vacuum, Point 14, and foam medium, Point 15, do not lie on straight line 13, but rather describe a curved line 16 for interpolation of reflected pressures of other mediums in addition to air and water. Although water has been used in the past as a medium for attenuating an explosive charge, it was not known until recently that water is probably one of the least desirable mediums for attenuation of an explosive charge. As an example, a one pound TNT (trinitrotoluene) explosive charge at a distance of 57 inches will create a reflected pressure of $10^4$ psi in water, $10^3$ psi in a vacuum, $10^2$ psi in air, and only 30 psi in foam as indicated in the graph of FIG. 1, Points 12, 14, 11 and 15, respectively. With this understanding it was observed that foam is a better medium for designing a device to attenuate the damaging affects of a terrorist bomb or other explosive charge.

It has been observed that two phase (gas-liquid) media, more commonly referred to as foam, demonstrate a number of unique features on shock wave processes heretofore not obtainable in prior art blast attenuating devices.

Commercially available foams can be classified into three basic types: 1. permanent plastic foams produced from linear polymers by blowing and then cooling a liquid melt, or by expanding solid polymer granules; 2.

non-permanent aqueous foams with medium expansion value produced using surface-active agents made from protein where a percent of the protein is changed to peptides by reaction with acids or bases or an aqueous film forming foam (AFFF). A subsequent injection of air produces a mass of relatively thick-walled bubbles with a high water content that occupies a volume of 5–20 times that of the original solution and persists for twelve hours or more; and 3. non-permanent aqueous foams with high expansion values produced from surface-active agents related to detergents which create masses of relatively thin-walled bubbles of relatively shorter duration.

The second of the above described foams is uniquely applied in the present invention to attenuate the shock wave of an explosive charge. The plasticity and resiliency of air bubbles in the foam together with the relatively high water content, wherein the water is spread out in the thin bubble walls, and concomitant high heat of vaporization thereof, tend to confine the damaging blast effects of an explosive device within an area surrounded by the foam.

Light and heat energy emitted by the explosion are substantially absorbed or diffused due to the chemical composition of the foam. Further, the 2,260 joules per gram per degree centigrade, heat of vaporization of water, tends to absorb and further dissipate energy from an explosion via the high water content of the foam; i.e. vaporization of water in the foam bubble walls.

Sound and concussion (shock wave) energy emitted by the explosion are also contained within the foam to a substantial degree. Though the foam air bubble walls are quite thin, they nevertheless contain the shock wave to a great extent through inertia (the walls resisting movement) and resiliency (the walls and air therein tending to compress and thereby absorb tensile or springing energy).

Particle or projectile type emissions of an exploding device within a foam are likewise substantially curtailed in velocity and distance of travel by loss of momentum due to frictional drag forces and compressional effects (supra) of air and foam walls encountered in their trajectory.

Further combustion and fire in areas exterior to the foam is prevented by foam energy absorption and water vaporization described above as well as by providing a smothering layer between combustants, and thereby preventing the entrance of $O_2$ (more oxidizer).

Previous methods used to contain an undesirable explosion were primarily limited to physical removal of the device to a safe place of detonation which created an extremely high risk of harm to the person transporting the device. Alternatively, sand bags could be piled around the device to contain the blast effects, which again subjects personnel to substantial risk during sand bag stacking, and furthermore sand and bags tend to fly through the air during an explosion. Where foam has been used to contain a fire or explosion it was generally necessary for personnel to remain in the area of high risk to lay the foam, or the water.

Figure 2:
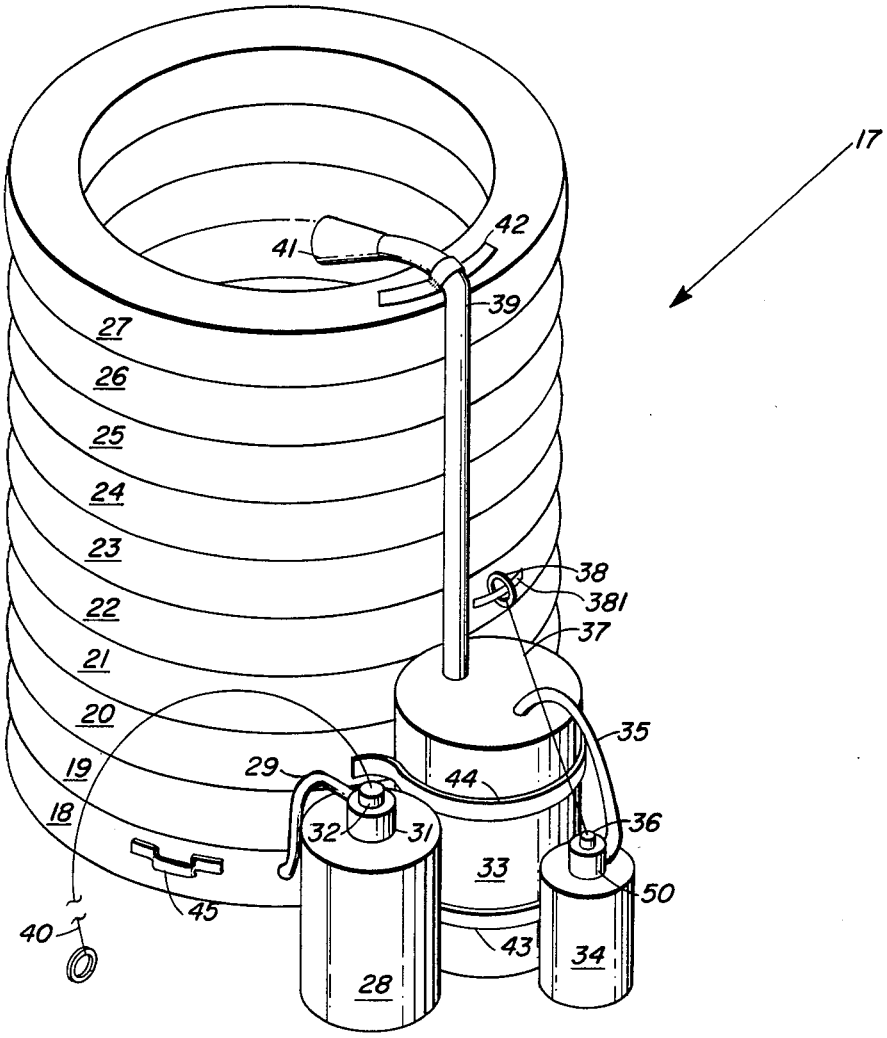
FIG. 2 is an orthogonal view of the blast attenuator device when inflated for use.

Referring now to FIG. 2 a fully inflated cylinder 17, made of flexible rubber or plastic, though not limited thereto, for containment of a body of foam is composed of a plurality of stacked, serially interconnected, toroidal shaped inflatable rings 18–27, much akin to a large child's swimming pool. Inflatable rings 18–27 inflate one at a time, consecutively beginning with the lower most inflatable ring 18. When inflatable ring 18 is fully inflated, inflatable ring 19 begins to inflate, followed in turn by inflatable ring 20, et seq. Cylinder 17 once inflated provides a foam containment device approximately 8 feet in height and 8 feet in diameter. A first gas cartridge 28, a compressed gas cartridge, which can be a commercially available carbon dioxide ($CO_2$) compressed gas cartridge, is coupled by a feed line 29 to inflatable ring 18 for inflating inflatable rings 18–27 on command. First gas cartridge 28 is provided with a first valve stem 31 having a first plunger 32 attached to a first lanyard 40, such that when first lanyard 40 is pulled, the cartridge is activated and erects (inflates) cylinder 17. First gas cartridge 28 can be any conventionally available inflating device on the market such as FSCN30003/63A120H1-17 (a $CO_2$ cartridge manufactured by American Safety) and valve stem 31 can be any conventionally manufactured stem available on the market such as FSCM96906/26545B2C0020 (also manufactured by American Safety). Any inflating cartridge suitable for inflating the equivalent of a 20 man life raft would also be sufficient for the present embodiment.

Coupled to first gas cartridge 28 is cannister 33. Cannister 33 contains a non-permanent, aqueous foam solution of medium expansion value. This foam is produced using surface active agents made from protein or aqueous film forming foam (AFFF), wherein 80 percent of the protein is changed to peptides by reaction with acids or bases such as caustic sodas for example; however, any commercially available foam can be used in the invention such as the AFFF produced by Ansul Co. (AFC-3) or by 3M Co. (FC-780B). Foam cannister 33 is provided with a second gas cartridge 34 for pressurizing the contents of cannister 33 through a second feed line 35. Second gas cartridge 34 is activated by a second plunger 36 within a second valve stem 50. Second plunger 36 is connected to inflatable ring 22 by a second lanyard 37, connecting ring 38 and patch 381 in such a manner that cartridge 34 turns on to pressurize cannister 35 thereby allowing foam to flow when cylinder 17 is half erected. A foam tube 39 allows passage of foam under pressure in cannister 33 to pass through a foam nozzle 41 for dispersement of foam into cylinder 17. Foam nozzle 41 can be any conventionally available foam nozzle on the market such as FSN4210-225-6225/NML1 (available from National Foam Systems Equipment). Foam nozzle 41 is flexibly affixed to the uppermost inflatable ring 27 by a maintaining patch 42. Likewise cannister 33 is flexibly connected to inflatable rings 18 and 20 by flexible bands 43 and 44, respectively. A first handle 45 is positioned on inflatable ring 18 at one side of cannister 33 for convenience in carrying the blast attenuating device when folded for transport. A second handle 46 (not shown in FIG. 2) is disposed on the opposite side of cannister 33.

Cylinder 17 when fully inflated comprises a predetermined volume. In developmental models, approximately 400 cubic feet was chosen as the volume. In FIG. 1, cylinder 17 is reduced in size approximately 200 times for ease of illustration of other parts of the invention. Since a normal foam/solution expansion ratio is 160/1, cannister 33 in the developmental model must be approximately 2.5 cubic feet in volume. It is to be understood that additional foam solution cannisters 33 as well as additional inflating first gas cartridges 28 can be positioned around cylinder 17 in like manner as described above for increased foam flow capacity and increased inflating capacity. If such is provided, both cannister 33 and first gas cartridge 28 could be of a smaller size than as described above.

Figure 3:
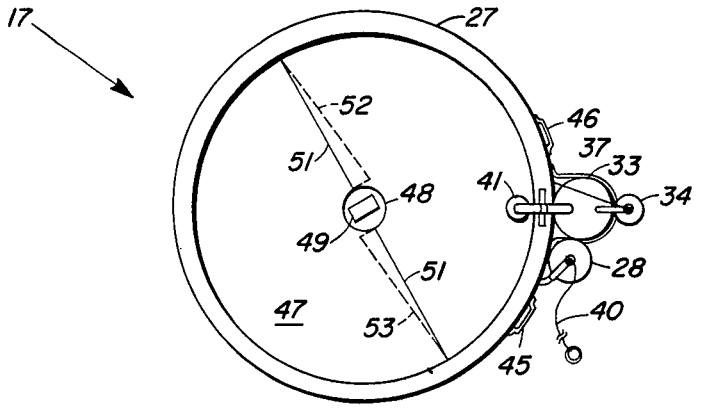
FIG. 3 is a top view of the blast attenuator device.

FIG. 3 is a top view of the blast attenuating device showing inflatable ring 27, cannister 33, first gas cartridge 28 first lanyard 40, second gas cartridge 34, second lanyard 37, and foam nozzle 41. First transporting handle 45 and second transporting handle 46 are bonded to inflatable ring 18 on either side of cannister 33 for convenience in carrying the blast attenuating device when folded for transport.

A flexible plastic (rubber or other pliable material) floor 47 is bonded to the bottom of cylinder 17 and is provided with a circular orifice 48 in the center thereof for insertion therethrough of an explosive device 49. Floor 47 is further provided with a slitted opening 51 across its diameter in such manner that overlapping extensions 52 and 53 allow for insertion of a larger explosive device than is displayed in FIG. 3, yet maintain a floor for confinement of foam within cylinder 17.

Figure 4:
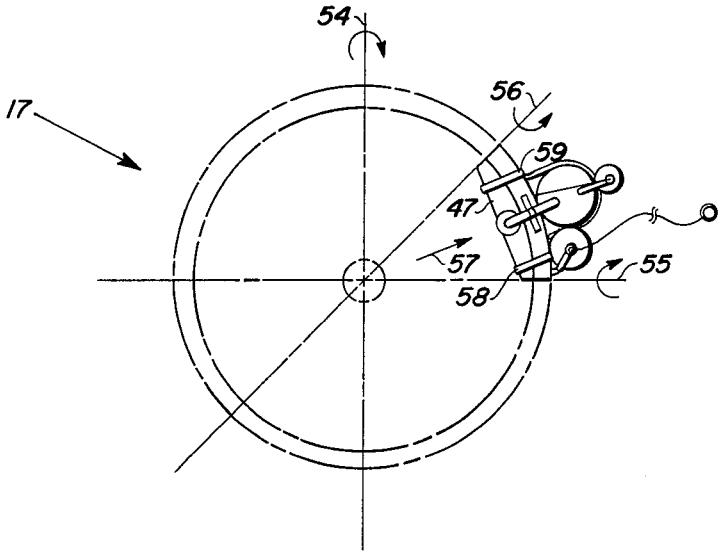
FIG. 4 is a top view illustrating the compact (folded) stored capability of the device.

FIG. 4 illustrates the compact, portable nature of the blast attenuator device. A top view of cylinder 17 is shown, for the most part, in dotted line format. Cylinder 17 is folded in half around line 54. A second fold is made around line 55 and a third fold is made around line 56. Floor 47 of cylinder 17 is rolled in the direction of 57. The rolled up device is then compactly bound by removable straps 58 and 59 and can be conveniently and easily carried by one or two people.

MODE OF OPERATION

Although there are many applications of which the abovedescribed blast attenuating device may be utilized, the primary object and purpose of the device is for containment of an explosive device, for example a terrorist bomb, positioned within the room of a building in which substantial damage would be incurred with explosion of the device. It is necessary that the blast attenuating device therefore be designed such that it is conveniently operated by a minimum of one or two people, that it can be easily carried through doors into relatively small rooms, and that it can be unfolded and automatically operative such that personnel are not required to be near the explosive device once the blast attenuator is placed thereon and activated.

To contain an explosive device the blast attenuator is unfolded in a reverse manner as described above for folding, placed over the bomb to be contained such that the bomb passes through floor 47 orifice 48. First gas cartridge 28 is activated by pulling first lanyard 40, which inflates cylinder 17, et seq. When inflatable ring 22 has been inflated, second lanyard 37 grows taut and turns on second gas cartridge 34 which then pressurizes foam cannister 33 which subsequently automatically pumps foam line 39 to nozzle 41 into cylinder 17. Cylinder 17 will then fill up with foam which will last for a few hours and will substantially contain the explosive blast effects of the terrorist bomb.

It should be understood that if a longer period of time be desired, additional foam could be supplied to cylinder 17 by an additional foam line and nozzle positioned along side nozzle 41 extending from a remotely situated continuous foam generator.

The present embodiments of this invention are to be considered in all respects as illustrative and not restrictive, the scope of the invention being indicated by the appended claims rather than by the foregoing description, and all changes which come within the meaning and range of equivalency of the claims therefore are intended to be embraced therein.

What is claimed is:

1. A bomb blast attenuator utilizing aqueous film forming foam (AFFF), comprising:

a foam containing body having an open top end, a bottom end, and a plurality of individually gas inflatable, serially interconnected and stacked, toroidal shaped flexible plastic rings defining an interior volume surrounded by walls;

a flexible plastic sheet bonded across said bottom end of said body, having an overlapping slit across its diameter and having a circular opening in the center of said sheet for facilitating the insertion of a blast producing device;

a first compressed gas cartridge having a valve;

a first tube connecting said valve on said first compressed gas cartridge to said body for inflating said rings on command;

a first lanyard connected to said valve on said first compressed gas cartridge for remote operation of said valve on said first compressed gas cartridge by an operator;

a foam canister attached to the exterior of said body and having a second tube extending from said foam canister to the open top end of said body;

a foam nozzle attached to said second tube for dispensing AFFF into said interior volume;

a second compressed gas cartridge having a valve;

a third tube connecting said valve on said second compressed gas cartridge to said foam canister for pressurizing said foam canister;

a second lanyard connected to said valve on said second compressed gas cartridge and connected to one of said plurality of rings for operating said valve on said second compressed gas cartridge in response to inflation of said rings; and at least two handles attached to at least one of said plurality of rings for use by an operator in transporting said blast attenuator.

* * * * *